US005709478A

United States Patent [19]

Chen

[11] Patent Number: 5,709,478

[45] Date of Patent: Jan. 20, 1998

[54] DRINKING DEVICE FOR DIVERS

[76] Inventor: Jiunn-Liang Chen, Floor 7, No. 83, Li-Kung Road, Taiping Hsiang, Taichung County, Taiwan

[21] Appl. No.: 741,937

[22] Filed: Oct. 31, 1996

[51] Int. Cl.[6] ..... B65D 33/02; B65D 33/16

[52] U.S. Cl. ..... 383/80; 128/202.15; 215/11.3; 215/389; 220/709

[58] Field of Search ..... 383/80, 119; 128/202.15; 215/11.3, 388, 389; 220/705, 709

[56] References Cited

U.S. PATENT DOCUMENTS

| | | | |
|---|---|---|---|
| 3,204,855 | 9/1965 | Boynton et al. | 215/11.3 |
| 4,398,533 | 8/1983 | Barker | 128/202.15 |
| 4,669,124 | 5/1987 | Kimura | 383/80 |
| 4,815,893 | 3/1989 | Feder | 128/202.15 |
| 5,257,865 | 11/1993 | Tani | 215/11.3 |
| 5,389,024 | 2/1995 | Chen | 128/202.15 |
| 5,524,612 | 6/1996 | Chen | 128/202.15 |

*Primary Examiner*—Stephen P. Garbe
*Attorney, Agent, or Firm*—Charles E. Baxley, Esq.

[57] ABSTRACT

A drinking device for divers includes a bag and a housing for receiving and for protecting the bag. A cylindrical member is engaged through the bag and the housing and includes an outer thread. A nut is engaged with the cylindrical member for securing the bag to the housing. A cap is engaged on the cylindrical member and a sealing ring is engaged between the cap and the cylindrical member for making a water tight seal. A ferrule is engaged with the cylindrical member and includes an annular flange for engaging with the cap and for retaining the cap in place. A sleeve may be secured to a snorkel assembly. The housing includes a pair of curved panels for engaging with the sleeve and for securing the housing to the sleeve.

6 Claims, 4 Drawing Sheets

DRINKING DEVICE FOR DIVERS

BACKGROUND OF THE INVENTION

1. Field of the Invention

The present invention relates to a drinking device, and more particularly to a drinking device for divers.

2. Description of the Prior Art

Typical drinking devices for divers comprise a flexible bag for receiving water and for supplying water to the mouthpiece of the divers. However, the bag is not protected and may be easily damaged.

The present invention has arisen to mitigate and/or obviate the afore-described disadvantages of the conventional drinking devices for divers.

SUMMARY OF THE INVENTION

The primary objective of the present invention is-to provide a drinking device having a protecting device for protecting the water bag.

In accordance with one aspect of the invention, there is provided a drinking device for divers, the drinking device comprises a bag for containing water, the bag including an opening, a housing provided for receiving and for protecting the bag, the housing including an orifice for aligning with the opening of the bag, and means for securing the bag to the housing.

The securing means includes a cylindrical member, the cylindrical member includes an outer thread and includes a bottom portion having an annular rib formed therein for engaging with the bag, a nut includes an inner thread for engaging with the outer thread of the cylindrical member for securing the bag to the housing, the cylindrical member includes a bore communicating with an interior of the bag.

The bag includes an annular flange extended downward from the opening, the annular rib of the cylindrical member is extended upward from the bottom portion for defining an annular channel and for engaging with the annular flange of the bag and for solidly securing the bag to the housing.

A cap is engaged on the cylindrical member, a sealing ring is engaged between the cap and the cylindrical member, the cap includes an outlet and including an annular flange for engaging with the sealing ring and for making a water tight seal between the cap and the cylindrical member, a ferrule includes an inner thread for engaging with the outer thread of the cylindrical member and includes an annular flange extended radially inward for engaging with the cap and for retaining the cap in place.

A sleeve may be secured to a snorkel assembly and a fixing means may fix the sleeve to the snorkel assembly. The housing includes a pair of curved panels for defining a room for engaging with the sleeve and for being secured to the sleeve, the curved panels each includes a tip for engaging with the sleeve and for securing the housing to the sleeve.

The sleeve includes at least one depression and includes at least two holes, the fixing means includes at least one fastener strap engaged in the depression of the sleeve and having two ends engaged through the holes of the sleeve for securing the sleeve to the snorkel assembly.

The sleeve includes a pair of longitudinal flanges and includes a bottom having a stop provided therein, the tips of the curved panels are engaged with the longitudinal flanges of the sleeve for securing the housing to the sleeve, the stop is provided for engaging with the curved panels and for limiting a relative movement between the curved panels and the sleeve and for preventing the curved panels from disengaging the sleeve.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
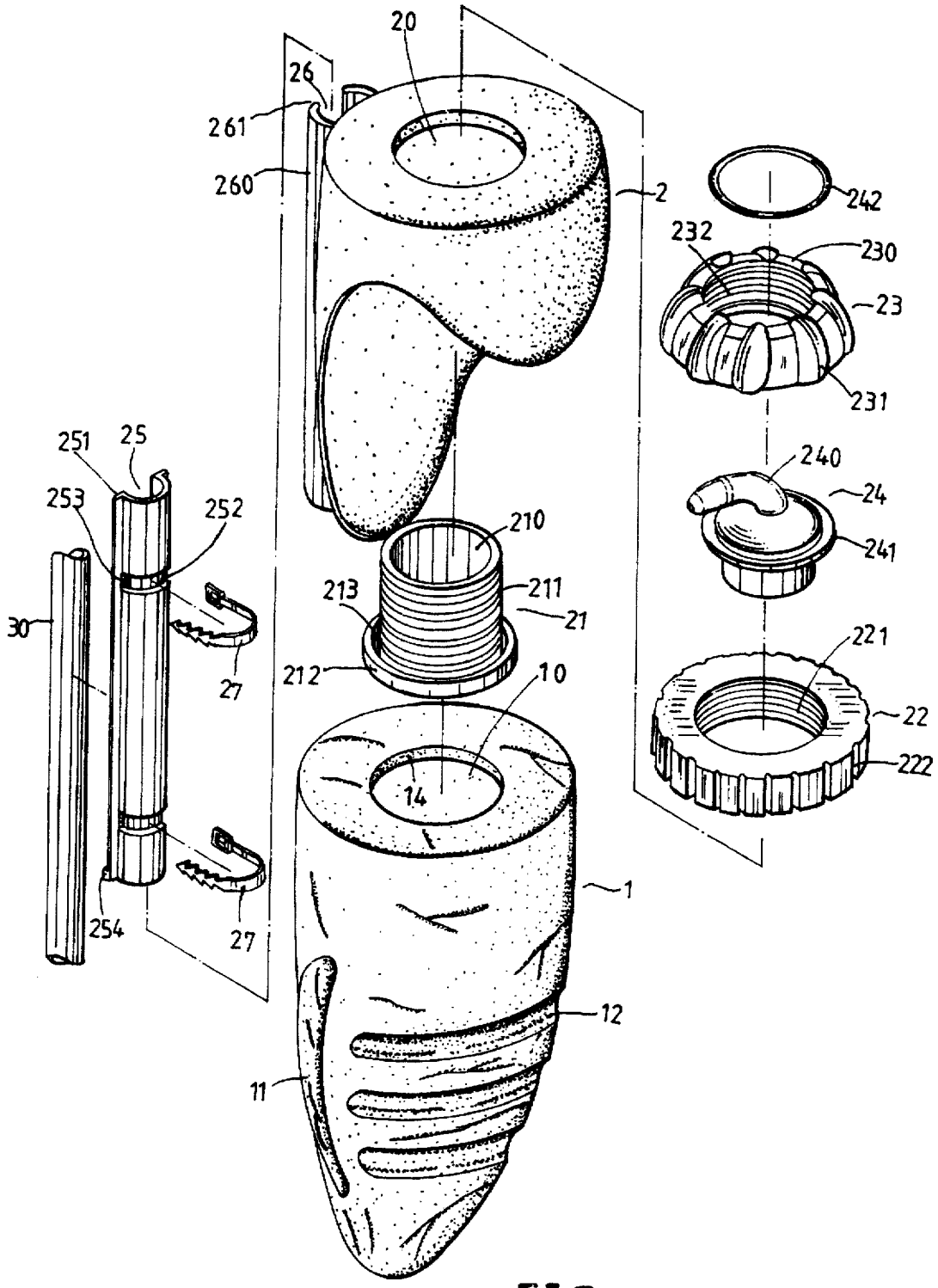
FIG. 1 is an exploded view of a drinking device in accordance with the present invention.
Figure 2:
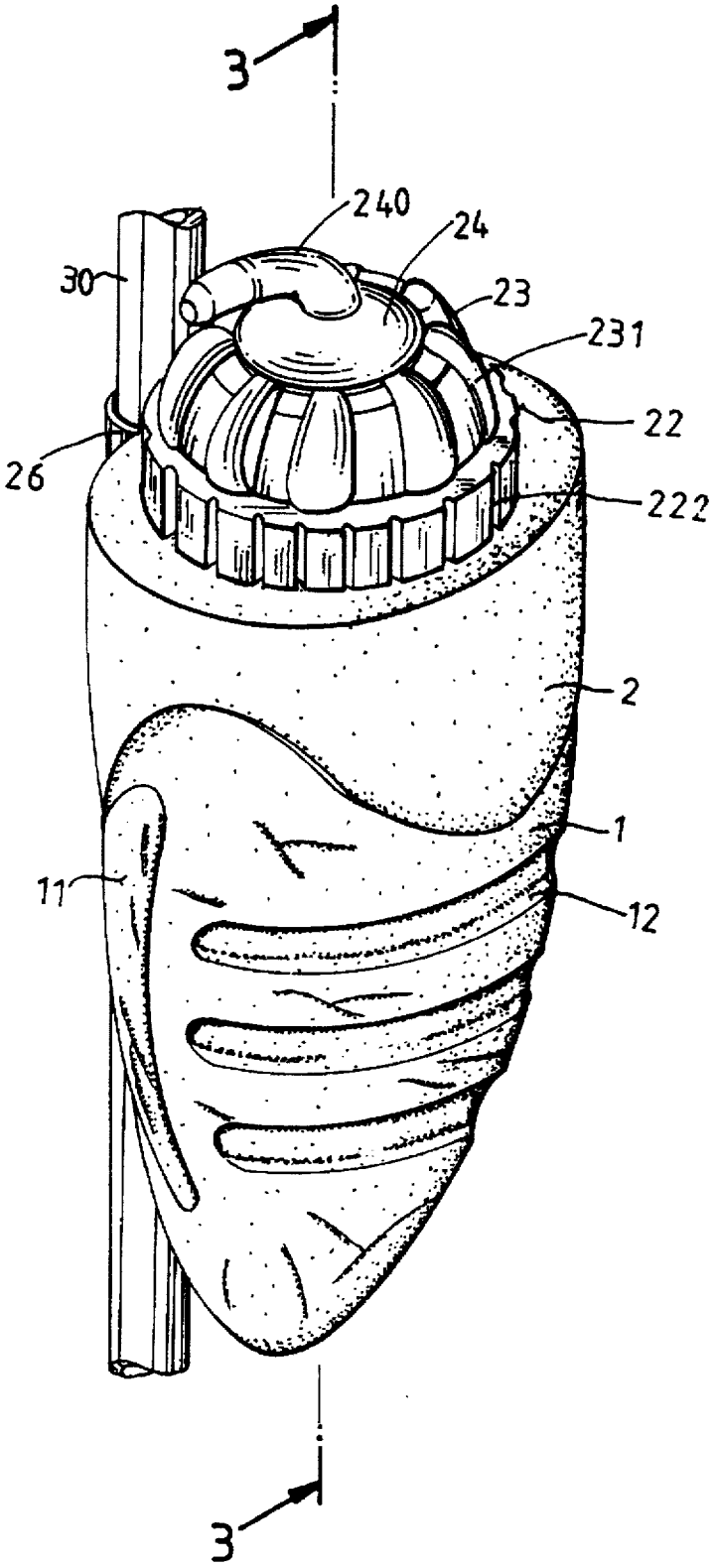
FIG. 2 is a perspective view of the drinking device.
Figure 3:
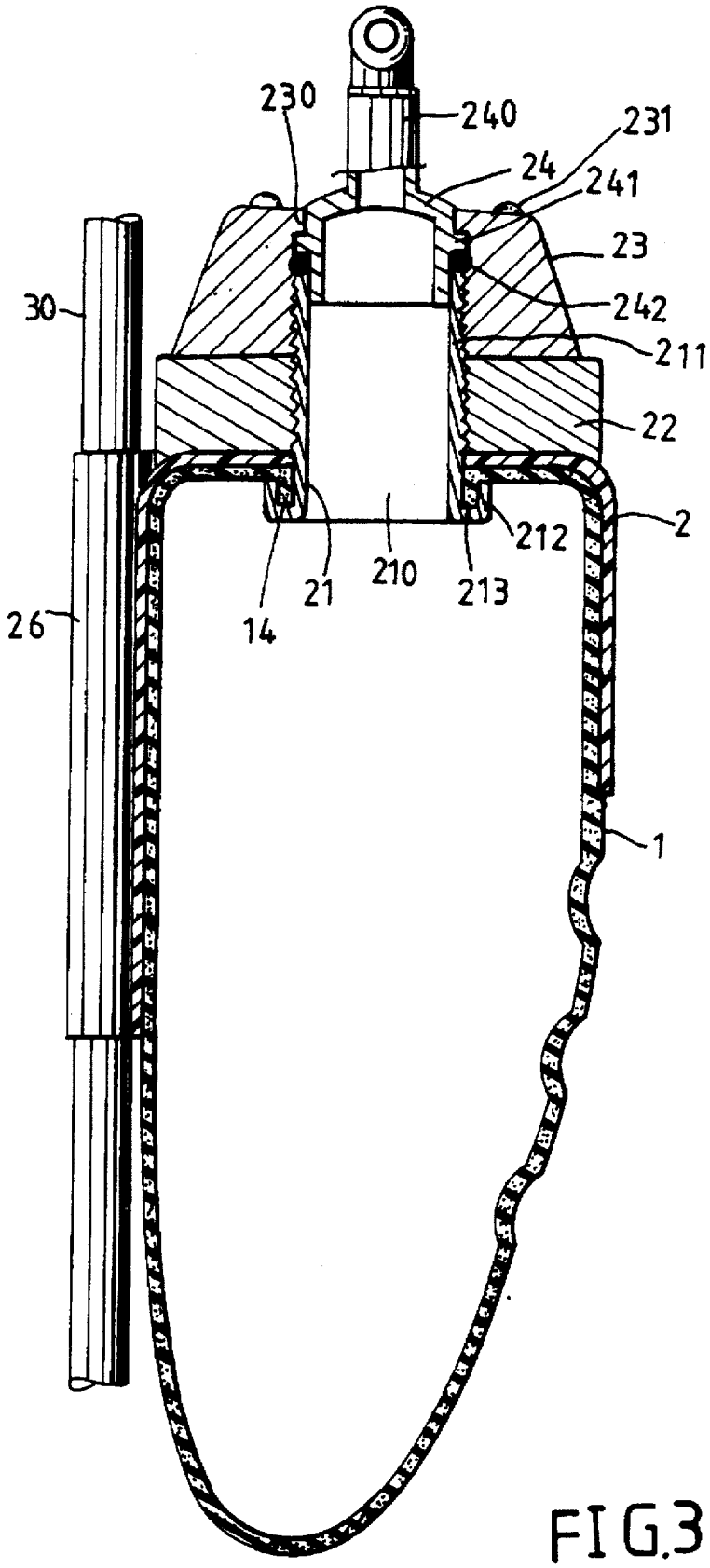
FIG. 3 is a cross sectional view taken along lines 3—3 of FIG. 2.

Referring to the drawings, and initially to FIGS. 1 to 3, a drinking device for divers in accordance with the present invention comprises a container or a bag 1 of resilient or flexible material for containing water. The bag 1 includes one or more reinforcing ribs 11 and one or more recesses 12. The bag 1 includes an opening 10 having an annular flange 14 (FIG. 3) extended downward from the opening 10. A housing 2 is provided for receiving and for protecting the bag 1 and includes an orifice 20 for aligning with the opening 10 of the bag 1. A cylindrical member 21 includes an annular rib 212 formed in the bottom portion and extended upward for defining an annular channel 213 and for engaging with the annular flange 14 of the bag 1. The cylindrical member 21 includes an outer thread 211 for engaging with an inner thread 221 of a nut 22 so as to secure the bag 1 to the housing 2. The nut 22 includes a number of slots 222 formed in the outer peripheral portion for facilitating the rotation of the nut 22. The cylindrical member 21 includes a bore 210 communicating with the interior of the bag 1 so as to form a water passage.

A cap 24 is engaged on the cylindrical member 21 and includes an outlet 240 and includes an annular flange 241 for engaging with a sealing ring 242 which is engaged on the cylindrical member 21 so as to make a water tight seal between the cap 24 and the cylindrical member 21. A ferrule 23 includes an inner thread 232 for engaging with the outer thread 211 of the cylindrical member 21 and includes an annular flange 230 extended radially inward for engaging with the cap 24 and for retaining the cap 24 in place. The ferrule 23 includes a number of protrusions 231 formed on the outer peripheral portion for facilitating the rotation of the ferrule 23. The outlet 240 may be coupled to the mouthpiece of the diver by hose for supplying water into the diver. The water contained in the bag 1 may be pumped into the mouth of the diver by squeezing the bag 1 or by any suitable pumping devices.

It is to be noted that the bag 1 is suitably engaged in and protected by the housing 2 so as to be prevented from being easily damaged.

Figure 4:
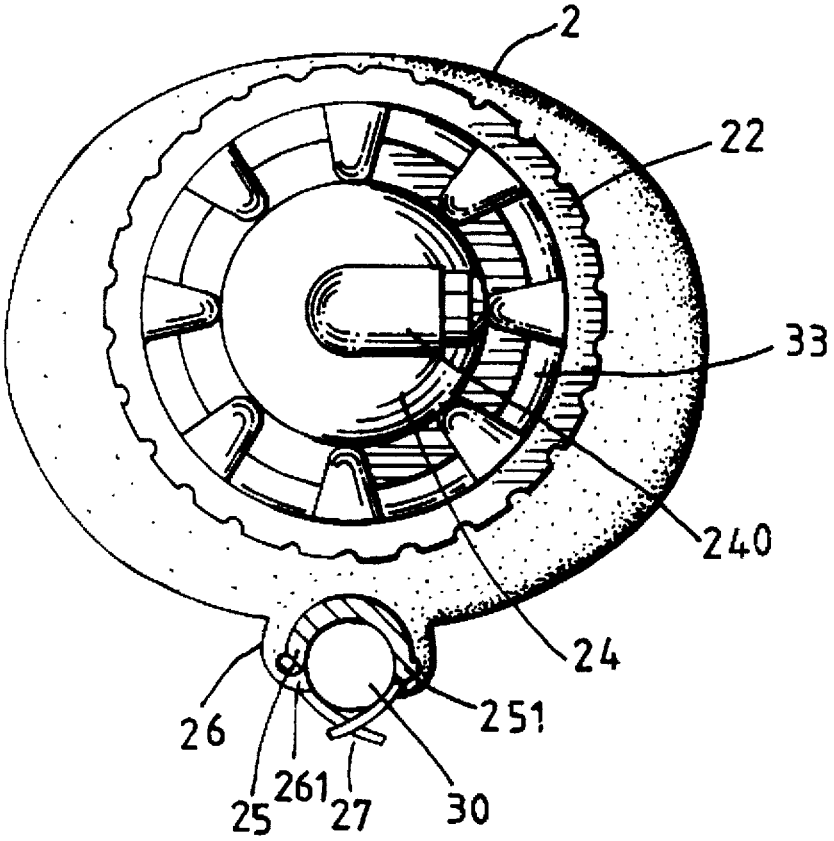
FIG. 4 is a top plane view of the drinking device.

The drinking device includes a sleeve 25 for securing to the air conduit 30 of the snorkel assembly. The sleeve 25 includes one or more depressions 252 for engaging with the fastener straps 27 and includes a number of holes 253 for engaging with the fastener straps 27 and for allowing the fastener straps 27 to secure the sleeve 25 onto the air conduit 30. The sleeve 25 includes a pair of longitudinal flanges 251 and includes a stop 254 provided in the bottom of the sleeve 25. The housing 2 includes a pair of curved panels 260 so as to define a room 26 for engaging with the sleeve 25 and for being secured to the sleeve 25. The curved panels 260 each includes a tip 261 for engaging with the longitudinal flanges 251 of the sleeve 25 and for securing the housing 2 to the sleeve 25, best shown in FIG. 4. The stop 254 is provided for engaging with the curved panels 260 for limiting the relative movement between the curved panels 260 and the sleeve 25 and for preventing the curved panels 260 from disengaging from the sleeve 25. It is preferable that the curved panels 260 are resilient and may apply a spring force against the sleeve 25 such that the curved panels 260 may further be secured to the sleeve 25 by force-fitted engagement between the curved panels 260 and the sleeve 25.

Accordingly, the drinking device in accordance with the present invention includes protective housing device for receiving and for protecting the water bag so as to prevent the water bag from being easily damaged.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A drinking device for divers, said drinking device comprising:

a bag for containing water, said bag including an opening, a housing provided for receiving and for protecting said bag, said housing including an orifice for aligning with said opening of said bag, and means for securing said bag to said housing, said securing means including a cylindrical member having an outer thread and having a bottom portion, said bottom portion of said cylindrical member including an annular rib for engaging with said bag, a nut being engaged with said outer thread of said cylindrical member for securing said bag to said housing, said cylindrical member including a bore communicating with an interior of said bag.

2. A drinking device according to claim 1, wherein said bag includes an annular flange, said annular rib of said cylindrical member is extended upward from said bottom portion of said cylindrical member for defining an annular channel and for engaging with said annular flange of said bag.

3. A drinking device according to claim 1 further comprising a cap engaged on said cylindrical member, a sealing ring engaged between said cap and said cylindrical member, said cap including an annular flange for engaging with said sealing ring, a ferrule including an inner thread for engaging with said outer thread of said cylindrical member and including an annular flange extended radially inward for engaging with said cap and for retaining said cap in place.

4. A drinking device for divers, said drinking device comprising:

a bag for containing water, said bag including an opening, a housing provided for receiving and for protecting said bag, said housing including an orifice for aligning with said opening of said bag, means for securing said bag to said housing, a sleeve for securing to a snorkel assembly, means for fixing said sleeve to the snorkel assembly, and said housing including a pair of curved panels for defining a room for engaging with said sleeve and for being secured to said sleeve, said curved panels each including a tip for engaging with said sleeve and for securing said housing to said sleeve.

5. A drinking device according to claim 4, wherein said sleeve includes at least one depression and includes at least two holes, said fixing means includes at least one fastener strap engaged in said depression of said sleeve and having two ends engaged through said holes of said sleeve for securing said sleeve to the snorkel assembly.

6. A drinking device according to claim 4, wherein said sleeve includes a pair of longitudinal flanges and includes a bottom having a stop provided therein, said tips of said curved panels are engaged with said longitudinal flanges of said sleeve for securing said housing to said sleeve, said stop is provided for engaging with said curved panels and for limiting a relative movement between said curved panels and said sleeve and for preventing said curved panels from disengaging from said sleeve.

* * * * *